US009395053B2

(12) United States Patent
Tsai et al.

(10) Patent No.: US 9,395,053 B2
(45) Date of Patent: Jul. 19, 2016

(54) LIGHT EMITTING DIODE LIGHT BULB HAVING A LIGHT DISPERSING LAYER ATTACHED ON AN ENVELOPE THEREOF

(71) Applicant: ADVANCED OPTOELECTRONIC TECHNOLOGY, INC., Hsinchu Hsien (TW)

(72) Inventors: Ming-Ta Tsai, Hsinchu (TW); Chung-Min Chang, Hsinchu (TW); Pei-Ying Wang, Hsinchu (TW)

(73) Assignee: ADVANCED OPTOELECTRONIC TECHNOLOGY, INC., Hsinchu Hsien (TW)

( * ) Notice: Subject to any disclaimer, the term of this patent is extended or adjusted under 35 U.S.C. 154(b) by 156 days.

(21) Appl. No.: 14/077,223

(22) Filed: Nov. 12, 2013

(65) Prior Publication Data

US 2014/0312762 A1 Oct. 23, 2014

(30) Foreign Application Priority Data

Apr. 22, 2013 (CN) ..... 2013 1 01399230

(51) Int. Cl.

| | |
|---|---|
| ***F21K 99/00*** | (2016.01) |
| ***F21V 5/00*** | (2015.01) |
| ***F21V 13/02*** | (2006.01) |
| *F21V 3/02* | (2006.01) |
| *F21Y 101/02* | (2006.01) |

(52) U.S. Cl.

CPC . *F21K 9/50* (2013.01); *F21K 9/135* (2013.01); *F21V 5/002* (2013.01); *F21V 13/02* (2013.01); *F21K 9/54* (2013.01); *F21V 3/02* (2013.01); *F21Y 2101/02* (2013.01)

(58) Field of Classification Search

CPC ..... F21K 9/50; F21K 9/135; F21V 5/002; F21V 13/02

See application file for complete search history.

(56) References Cited

U.S. PATENT DOCUMENTS

| | | | | |
|---|---|---|---|---|
| 8,704,442 | B2 * | 4/2014 | Lenk et al. | 313/512 |
| 8,752,984 | B2 * | 6/2014 | Lenk et al. | 362/311.02 |
| 2004/0026683 | A1 * | 2/2004 | Yamada et al. | 257/10 |
| 2007/0128413 | A1 | 6/2007 | Chuang et al. | |
| 2008/0253129 | A1 | 10/2008 | Lin et al. | |
| 2011/0280015 | A1 * | 11/2011 | Li et al. | 362/240 |
| 2012/0081880 | A1 * | 4/2012 | Narendran | F21K 9/135 362/84 |
| 2012/0170282 | A1 * | 7/2012 | Lin et al. | 362/341 |
| 2012/0236573 | A1 * | 9/2012 | Yamamoto et al. | 362/311.02 |
| 2013/0027904 | A1 * | 1/2013 | Fan | 362/84 |
| 2013/0249384 | A1 * | 9/2013 | Sawabe et al. | 313/504 |
| 2014/0140068 | A1 * | 5/2014 | Eom et al. | 362/307 |

(Continued)

FOREIGN PATENT DOCUMENTS

| | | | |
|---|---|---|---|
| CN | 101290095 A | | 10/2008 |
| CN | 201293216 Y | * | 8/2009 |
| CN | 101769470 A | | 7/2010 |
| CN | 202769359 U | | 3/2013 |

(Continued)

*Primary Examiner* — Joseph L Williams

(74) *Attorney, Agent, or Firm* — ScienBiziP, P.C.

(57) ABSTRACT

An LED light bulb includes a holder for electrically connecting with a power source, an LED mounted on the holder, an envelope mounted on the holder and covering the LED, and a light dispersing plate attached to an inner surface of the envelope. The light dispersing plate is made of a transparent material with a plurality of irregular air bubbles therein. Light generated by the LED and radiating to the envelope is refracted, reflected and scattered by the bulbs before the light emits out of the LED light bulb.

20 Claims, 3 Drawing Sheets

(56) References Cited

U.S. PATENT DOCUMENTS

| | | | | |
|---|---|---|---|---|
| 2014/0233214 | A1* | 8/2014 | Berben | 362/84 |
| 2014/0253844 | A1* | 9/2014 | Yamamoto et al. | 349/64 |

FOREIGN PATENT DOCUMENTS

| | | | |
|---|---|---|---|
| TW | M291538 | U | 6/2006 |
| TW | 200840969 | A | 10/2008 |

* cited by examiner

LIGHT EMITTING DIODE LIGHT BULB HAVING A LIGHT DISPERSING LAYER ATTACHED ON AN ENVELOPE THEREOF

BACKGROUND

1. Technical Field

The present disclosure relates to LED (light emitting diode) lamps, and more particularly to an LED light bulb having evenly distributed light emitted therefrom.

2. Description of Related Art

LEDs have many beneficial characteristics, including low electrical power consumption, low heat generation, long lifetime, small volume, good impact resistance, fast response and excellent stability. These characteristics have enabled the LEDs to be widely used as a light source in electrical appliances and electronic devices.

A conventional LED light bulb includes a plurality of LEDs mounted on a center of the LED light bulb. The LEDs generate a smooth round light field with a radiation angle of 120 degrees (±60 degrees). The light emitted from the LEDs is mainly concentrated at a center of the LED light bulb. The light at a periphery of the LED light bulb is relatively poor. Therefore, the light of the LED light bulb is not evenly distributed.

What is needed, therefore, is an improved LED light bulb which can overcome the above described shortcomings.

DETAILED DESCRIPTION

Embodiments of an LED light bulb in accordance with the present disclosure will now be described in detail below and with reference to the drawings.

Figure 1:
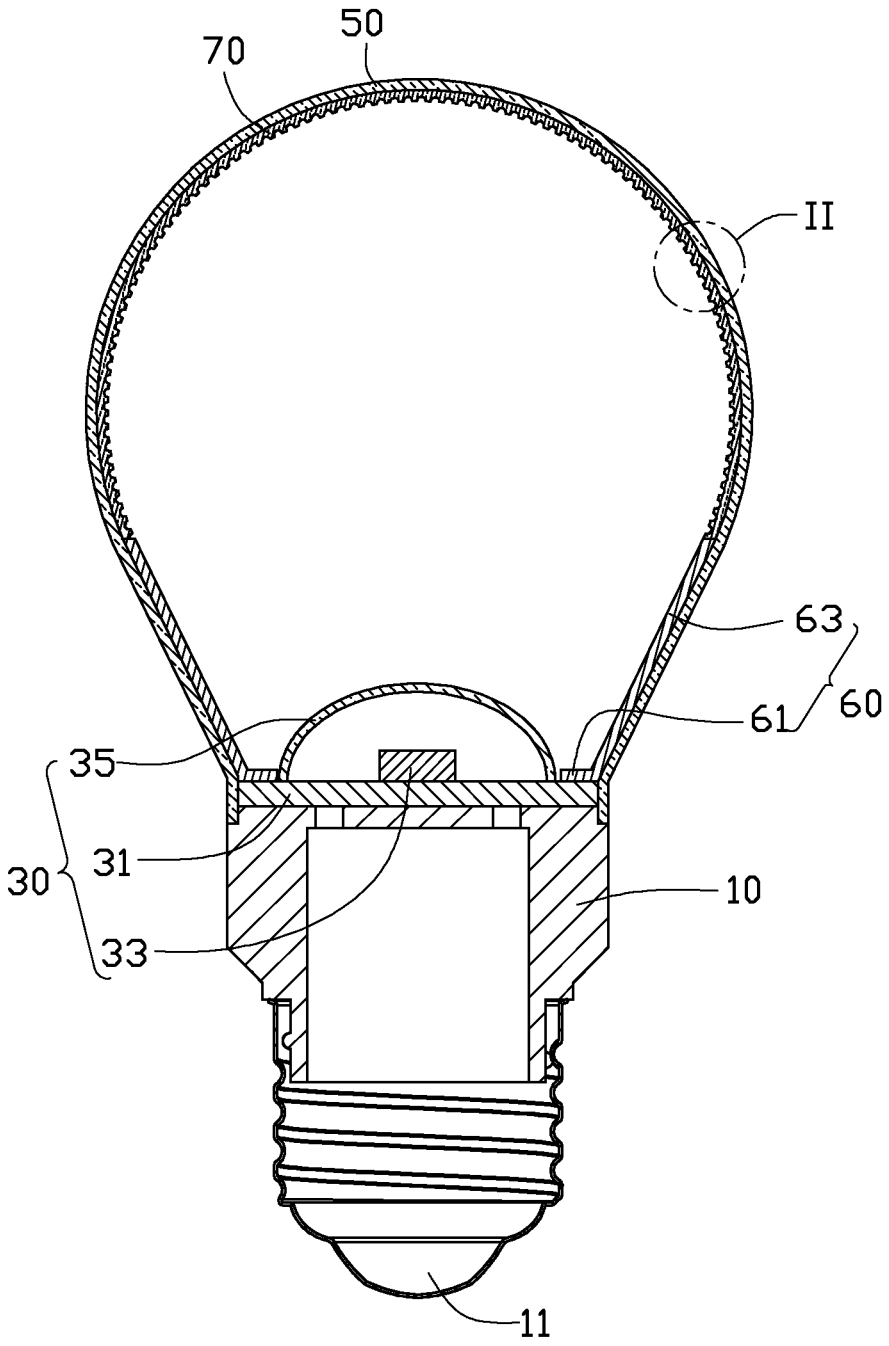
FIG. 1 is a cross sectional view of an LED light bulb according to a first embodiment of the present disclosure.

Referring to FIG. 1, an LED light bulb of a first embodiment is shown. The LED light bulb includes a holder 10, an LED module 30 mounted on a top end of the holder 10, an envelope 50 mounted on the holder 10 and covering the LED module 30, a light reflecting cup 60 and a light dispersing plate 70 attached to an inner surface of the envelope 50.

The holder 10 is a hollow tube with a bottom end thereof being closed. A metallic patch 11 is formed on an outside of the bottom end of the holder 10. The metallic patch 11 functions as a positive electrode, and a threaded periphery (not labeled) of the holder 10 functions as a negative electrode to electrically connect with a power source to drive the LED module 30 to lighten. The holder 10 can be an Edison screw base, such as E26 screw base. The holder 10 is a standard element, so the LED light bulb can be directly connected to a standard socket matching with the holder 10 to electrically connect with the power source.

The LED module 30 includes a printed circuit board 31, an LED 33 mounted on a center of a top surface of the printed circuit board 31, and a lens 35 mounted on the top surface of the printed circuit board 31 and covering the LED 33. The printed circuit board 31 is mounted on the top end of the holder 10 and electrically connects with the positive and negative electrodes of the holder 10.

Alternatively, in other embodiment, the LED lamp includes a plurality of LEDs 33, and the LEDs 33 are covered by the lens 35.

The envelope 50 is made of a light permeable material and has a hollow, bulb-like shape. A bottom edge of the envelope 50 is embedded in a periphery of the top end of the holder 10.

Figure 2:
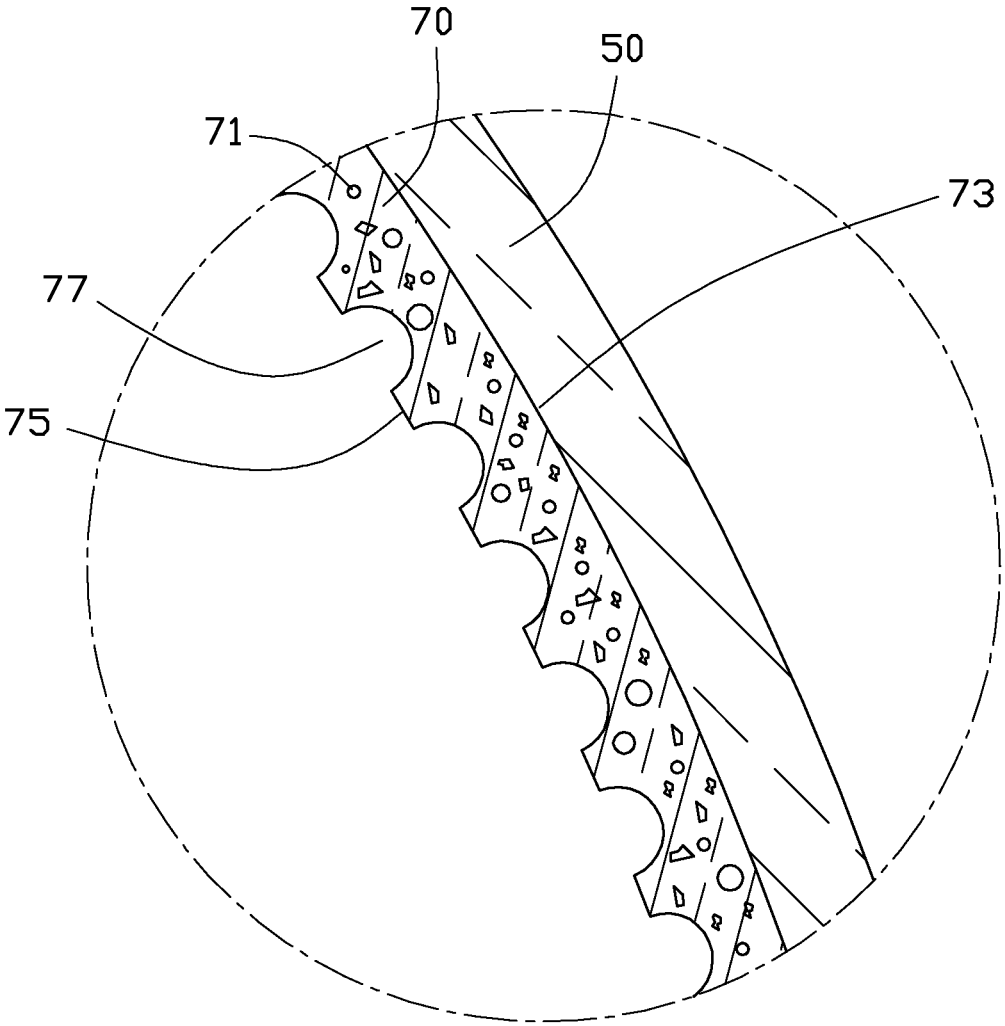
FIG. 2 is a partially enlarged view of a light dispersing plate of the LED light bulb of FIG. 1, taken along circle II thereof.

Referring to FIG. 2, the light dispersing plate 70 is a flexible plate and has a uniform thickness. The light dispersing plate 70 is attached to an upper portion of the inner surface of the envelope 50 to disperse light emitted from the LED 33. The light dispersing plate 70 is made of a transparent material with a plurality of irregular air bubbles 71 therein. To form the light dispersing plate 70, liquid transparent material, for example, liquid transparent resin, is provided; then the liquid transparent material is whipped up rapidly to make air enter the liquid transparent material. The air is entrapped in the liquid transparent material after it is cured, whereby the air forms the air bubbles 71 in the light dispersing plate 70 A refractive index of the air bubble 71 is less than that of the transparent material. The air bubbles 71 have different shapes and sizes and are distributed over an entirety of the light dispersing plate 70. Accordingly, when light moves through the light dispersing plate 70, the light will be refracted, reflected and scattered into different directions.

In this embodiment, the light dispersing plate 70 faces a light field of the LED 33.

The light dispersing plate 70 includes a light outputting surface 73 and a light inputting surface 75 opposite to the light outputting surface 73. The light outputting surface 73 is attached to the inner surface of the envelope 50. The light inputting surface 75 faces the LED 33. A micro structure 77 is defined in the light inputting surface 75. The micro structure 77 is a plurality of hemispherical recesses recessing from the light inputting surface 75 toward the light outputting surface 73. A volume of each recess is larger than that of each air bubble 71.

The reflecting cup 60 is attached to a lower portion of the envelop 50 and connected to a periphery of the top surface of the printed circuit board 31. The reflecting cup 60 is a hollow tube and reflects light emitted from the LED 33. The reflecting cup 60 includes a first reflecting portion 61 and a second reflecting portion 63. The first reflecting portion 61 is disk-shaped, surrounds the lens 35, and is mounted on the printed circuit board 31. The second reflecting portion 63 is has a shape of a tapered tube and extends from a periphery of the first reflecting portion 61 toward the light dispersing plate 70. A top end of the second reflecting portion 63 abuts against a bottom end of the light dispersing plate 70. A height of the second reflecting portion 63 is larger than that of the LED module 30 and that of the lens 35. The reflecting cup 60 is made of a light opaque material with high reflecting efficiency. In this embodiment, the reflecting cup 60 is made of silver.

In operation, light emitted from the LED 33 radiates towards the light inputting surface 75 of the light dispersing plate 70. A part of the light radiates to the air bubbles 71 and is reflected and refracted by the air bubbles 71 to different directions to make the light be evenly distributed before it travels out of the envelope 50. Another part of light radiates to the micro structure 77 and is reflected and refracted by the micro structure 77 to different directions before it travels out of the envelop 50. The reflecting cup 60 reflects light, which is reflected or refracted by the light dispersing plate 70 towards the printed circuit board 31, upwardly to make the reflected light be reflected and refracted by the light dispersing plate 70 again before it travels through the envelope 50. Accordingly, the light generated by the LED 33 can uniformly radiate out of the LED light bulb In this state, not only the light can be evenly distributed in the light field, but also the light utilization efficiency of the LED light bulb is improved.

Figure 3:
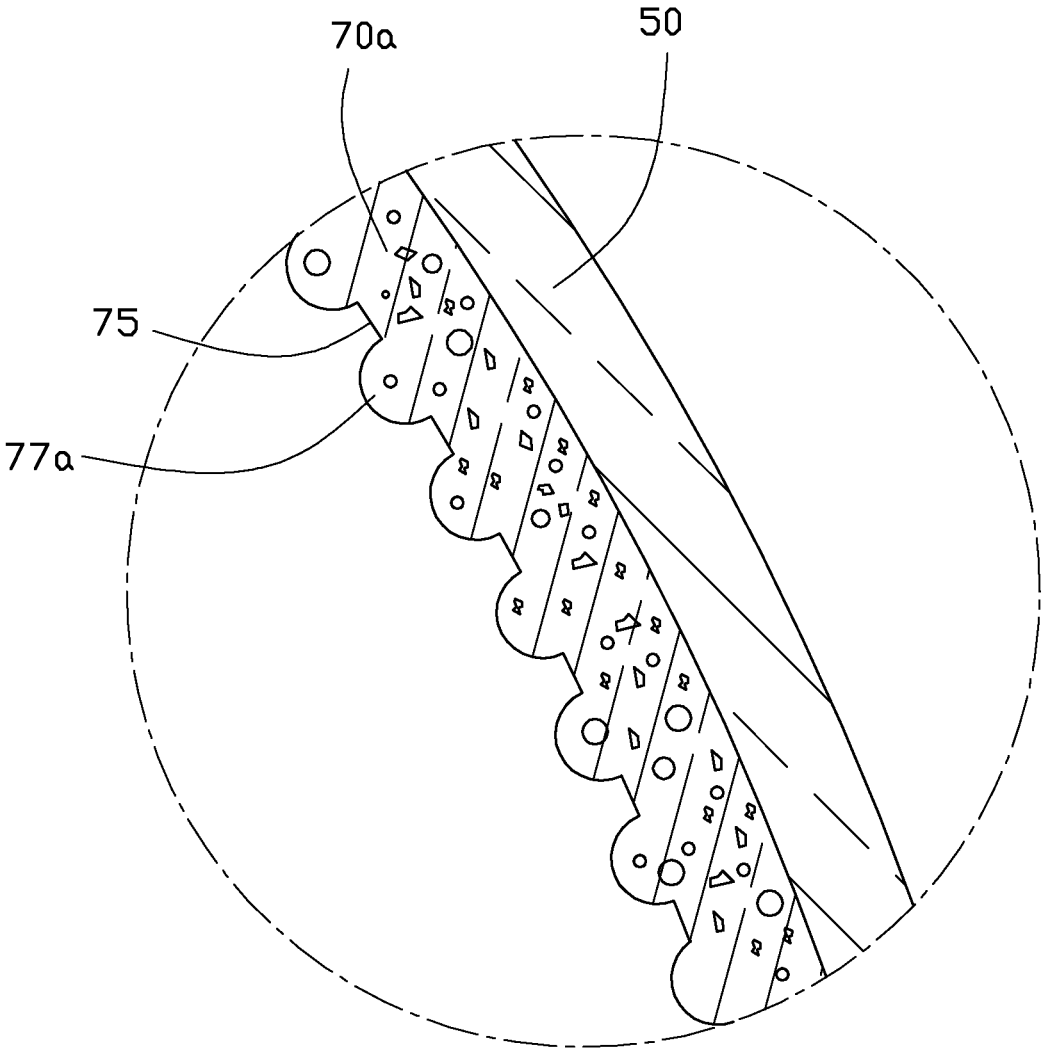
FIG. 3 is a partially enlarged view of a light dispersing plate of the LED light bulb according to a second embodiment of the present disclosure.

Referring to FIG. 3, a light dispersing plate 70*a* of a second embodiment is shown. The light dispersing plate 70*a* is similar to the light dispersing plate 70 of the first embodiment and a different therebetween is that a micro structure 77*a* is a plurality of hemispherical protrusions protruding from the light inputting surface 75.

It is to be further understood that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. A light emitting diode (LED) light bulb comprising:
- a holder configure for electrically connecting with a power source;
- an LED mounted on the holder;
- an envelope mounted on the holder and covering the LED;
- a light dispersing plate attached to an inner surface of the envelope, and the light dispersing plate being made of transparent material with a plurality of air bubbles therein, the air bubbles having different sizes and shapes; and
- a light reflecting cup directly attached to the inner surface of the envelope.

2. The LED light bulb of claim 1, wherein the dispersing plate faces a light field of the LED.

3. The LED light bulb of claim 1, wherein the light dispersing plate is a flexible plate and has a uniform thickness, the light dispersing plate comprises a light outputting surface attached to the envelope and a light inputting surface facing the LED, and a micro structure is formed on the light inputting surface.

4. The LED light bulb of claim 3, wherein the micro structure has a plurality of hemisphere-shape structures.

5. The LED light bulb of claim 4, wherein the micro structure is a plurality of hemispherical recesses recessing from the light inputting surface toward the light outputting surface.

6. The LED light bulb of claim 5, wherein a volume of each recess is larger than that of each air bubble.

7. The LED light bulb of claim 4, wherein the micro structure is a plurality of hemispherical protrusions protruding from the light inputting surface.

8. The LED light bulb of claim 1, wherein the reflecting cup is attached to a lower portion of the envelope and a top end of the reflecting cup abuts against a bottom end of the light dispersing plate.

9. The LED light bulb of claim 8, wherein the reflecting cup is a hollow tube and comprises a first reflecting portion mounted on the holder and a second reflecting portion extending upwardly from a periphery of the first reflecting portion and directly attached to the inner surface of the envelope.

10. The LED light bulb of claim 1, wherein the LED, the light reflecting cup and the light dispersing plate are received in the envelope and located higher than the bottom edge of the envelope.

11. A light emitting diode (LED) light bulb comprising:
- a printed circuit board;
- an LED mounted on the printed circuit board;
- an envelope covering the LED and surrounding the printed circuit board;
- a light dispersing plate attached to an inner surface of the envelope, and the light dispersing plate being made of a transparent material with a plurality of air bubbles therein, the bubbles having different sizes and shapes; and a light reflecting cup directly attached to the inner surface of the envelope.

12. The LED light bulb of claim 11, wherein the light dispersing plate is a flexible plate and has a uniform thickness, the light dispersing plate comprises a light outputting surface attached to the envelope and a light inputting surface facing the LED, and a micro structure is formed on the light inputting surface.

13. The LED light bulb of claim 12, wherein the micro structure has a plurality of hemispherical structures.

14. The LED light bulb of claim 12, wherein the micro structure is a plurality of hemispherical recesses recessing from the light inputting surface toward the light outputting surface.

15. The LED light bulb of claim 12, wherein the micro structure is a plurality of hemispherical protrusions protruding from the light inputting surface.

16. The LED light bulb of claim 11, wherein the reflecting cup is attached to a lower portion of the envelope and a top end of the reflecting cup abuts against a bottom end of the light dispersing plate.

17. The LED light bulb of claim 16, wherein the reflecting cup is a hollow tube and comprises a first reflecting portion mounted on the printed circuit board and a second reflecting portion extending upwardly from a periphery of the first reflecting portion and directly attached to the inner surface of the envelope.

18. The LED light bulb of claim 17, wherein a lens is mounted on the printed circuit board and covers the LED.

19. The LED light bulb of claim 18, wherein a height of the second reflecting portion is larger than that of the lens.

20. The LED light bulb of claim 18, wherein the LED, the printed circuit board, the lens, the light reflecting cup and the light dispersing plate are received in the envelope and located higher than the bottom edge of the envelope.

* * * * *